US005722754A

United States Patent [19]

Langner

[11] Patent Number: 5,722,754

[45] Date of Patent: Mar. 3, 1998

[54] FULL SPECTRUM LIGHT SOURCE FOR COMPUTER MONITOR

[76] Inventor: Eli Langner, 25 St. Nicholas St., Lynbrook, N.Y. 11563

[21] Appl. No.: 844,637

[22] Filed: Apr. 21, 1997

[51] Int. Cl.[6] ..... H05B 35/00

[52] U.S. Cl. ..... 362/1; 362/33; 362/234; 362/253

[58] Field of Search ..... 362/1, 33, 28, 362/85, 234, 253, 396

[56] References Cited

U.S. PATENT DOCUMENTS 5,379,201 1/1995 Friedman ..... 362/191
5,432,504 7/1995 Shaw et al. ..... 340/815.73

OTHER PUBLICATIONS

Product data information of CHROMALUX–identified light bulb of Lumiram Corporation of Mamaroneck, NY 10543, no publication date given.

*Primary Examiner*—Stephen F. Husar
*Attorney, Agent, or Firm*—Myron Amer PC

[57] ABSTRACT

Auxiliary lighting for a computer monitor display screen that consists of simulated natural daylight, as provided by commercially available full spectrum bulbs. Using to advantage the usual sitting position of a user which places the upper edge of the display screen at his/her eye level, the full spectrum light source is mounted on the display screen upper edge to maximize the impingement on the user's eyes of full spectrum light to ease the eye strain caused by partial full spectrum light of computer-generated illumination on the display screen.

1 Claim, 1 Drawing Sheet

FULL SPECTRUM LIGHT SOURCE FOR COMPUTER MONITOR

The present invention relates generally to improvements in auxiliary lighting for a computer monitor display screen, the improvements more particularly obviating eye strain as might be caused by prolonged viewing of illuminated text and numerical indicia displayed on the screen.

EXAMPLES OF THE PRIOR ART

Complained of eye strain of users of computer monitors has fostered the design in the prior art of computer monitor-attached auxiliary light sources, as exemplified by supplemental front lighting of the display screen as illustrated and described in U.S. Pat. No. 5,379,201 issued to Arthur S. Friedman for "Portable Light for Laptop Computer" on Jan. 3, 1995, and four sides supplemental display screen lighting as illustrated and described in U.S. Pat. No. 5,432,504 issued to Shaw et al. for "Visual Display Terminal Device & Method for Eye Strain Reduction" on Jul. 11, 1995, to mention but a few. These and all other known prior art patents addressing the eye strain problem proffer as the solution increasing the amount of lighting made available for viewing which, in practice, might be helpful but is not totally effective for the purposes intended, because the harsh illumination emitted by the displayed indicia on the computer monitor screen is not neutralized or otherwise prevented from causing eye strain.

Broadly, it is an object of the present invention to provide eye strain-obviating supplemental lighting overcoming the foregoing and other shortcomings of the prior art.

More particularly, it is an object to supply supplemental lighting for viewing a computer monitor display screen adding not only to the amount of light made available to the user, but also having a significant restful beneficial effect when impinging on the user's eyes, the latter being achieved by using to advantage the seated position of the viewer in facing relation to the computer monitor screen, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
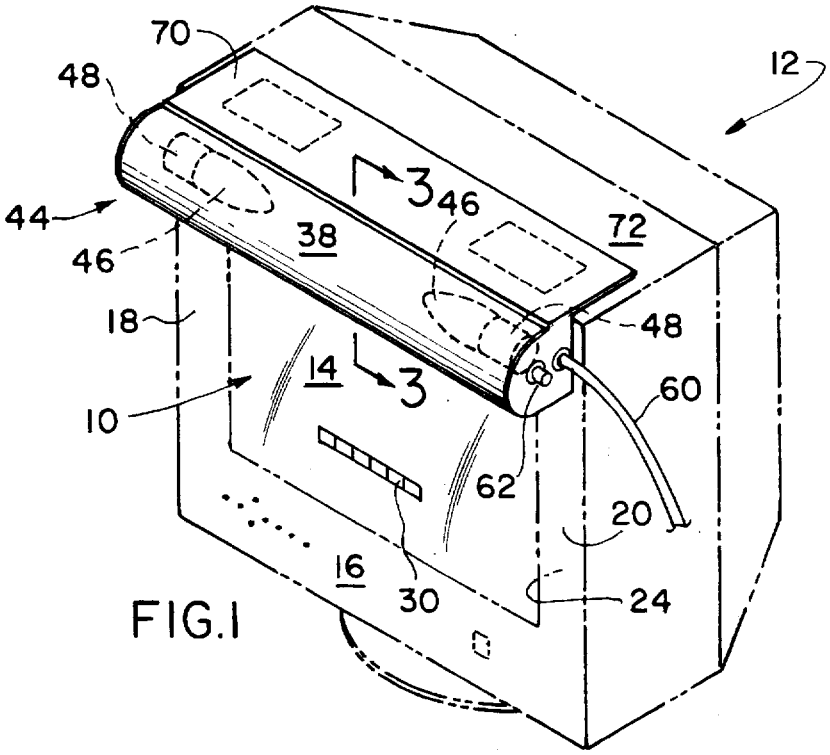
FIG. 1 is a perspective view of the within inventive light source applied to a computer monitor.
Figure 2:
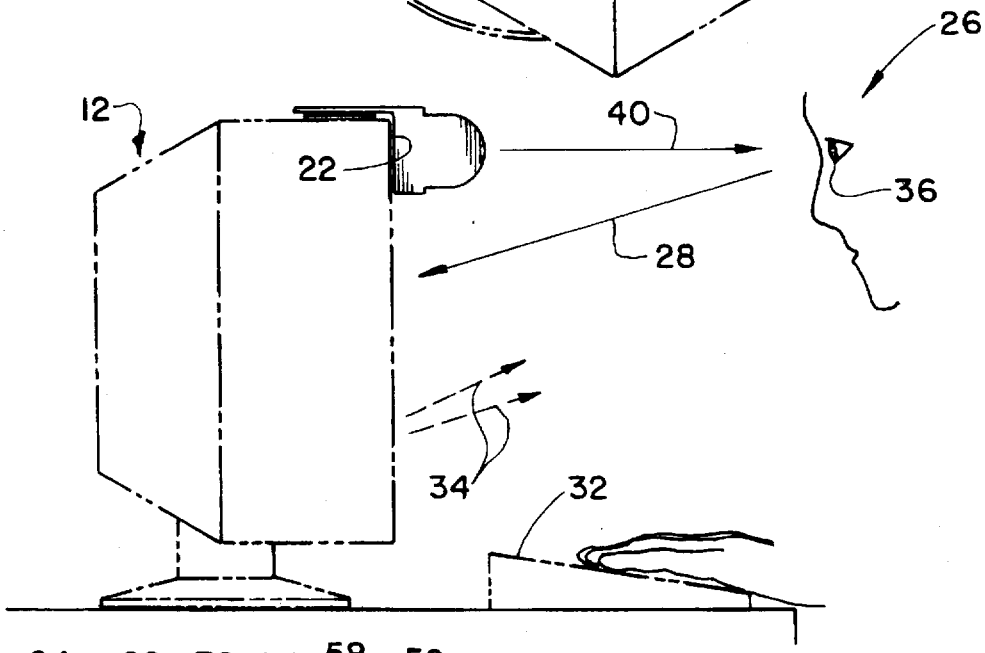
FIG. 2 is a left side elevational view showing further details.
Figure 3:
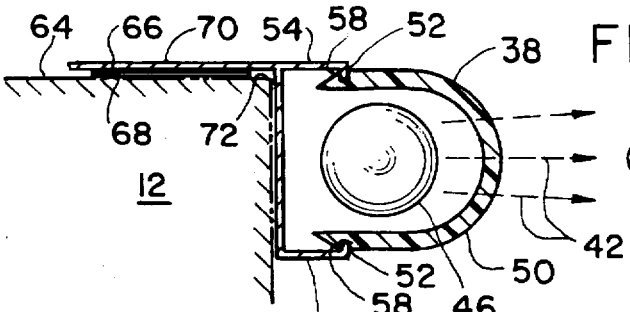
FIG. 3 is a partial elevational view in sections as taken along line 3—3 of FIG. 1.
Figure 4:
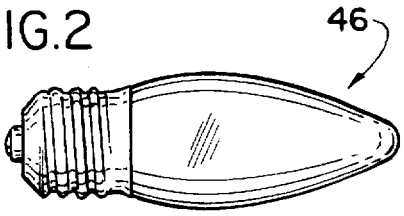
FIG. 4 is an isolated view of a bulb providing a source of light obviating eye strain in accordance with the present invention.

Of a well-known construction and operating mode is a computer operatively connected to a cathode ray tube 10 disposed within a computer housing or monitor 12 which frames the front screen 14 of the cathode ray tube with a bottom 16, opposite sides 18 and 20, and a top 22 which cooperate to bound an opening 24 through which the front screen 14 is displayed to a viewer 26 seated in facing relation to, and thus having a line of sight 28 to the computer-generated text 30 displayed, using a keyboard 32, on the screen 14, said displayed text 30 being of only partial spectrum illumination 34 and, as a consequence typically producing eye strain after several hours of use.

Underlying the present invention is the recognition that supplementing the partial spectrum illumination 34 with full spectrum illumination made to impinge directly on the eyes 36 of the user 26 significantly lessens or obviates the eye strain, and that this is readily achieved by using to advantage the seated position of the user 26 in facing relation to the screen 14 and the strategic location of a full spectrum light source 38 at the eye level 40 of the user 26 and thus in the path of the emitted full spectrum light source rays 42 enabling the referred to eye-impingement with said rays to occur.

To the above end, there is provided an auxiliary housing 44 for light bulbs 46 commercially available from Lumiram Corporation of Mamaroneck, N.Y. which provide full spectrum illumination 42, by which is meant illumination which closely approximates or simulates natural daylight. The bulbs 46 are threadably mounted in a known manner, as at 48, to extend inwardly from opposite sides of the housing 44 and are covered, but not shaded, by a clear plastic light diffuser 50 held in place by depending projections 52 on extending housing legs 54 and 56 seated in notches 58 of the light diffuser 50, and through which the full spectrum illumination rays 42 emanating from the bulbs 46 are diffused, as noted at 40, into the area of the user's eyes 36 and thus providing the eye strain-obviating impingement therewith. The bulbs 46 are electrically connected to power via a power cable 60 and the circuitry includes an on-off switch 62.

In a preferred embodiment, the full spectrum light source 38 within the housing 44 is mounted at eye level 40 to extend forwardly of the monitor top edge 64 by cooperating VELCRO loop and hook fastener patches 66 and 68, wherein the patches are adhesively secured respectively to a rearward extending leg 70 of the housing 44 and an underlying monitor top panel 72 and the loop and hook fasteners placed in face-to-face engaging relation to each other.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An improved light source means for a screen displaying computer-generated text to a viewer seated in facing relation to said screen, said improved light source means comprising a housing framing said screen consisting of a bottom, opposite sides and a top bounding a display opening through which said computer-generated text is displayed to said seated viewer, a cathode ray tube operated by said computer having a front screen disposed in said display opening on said front screen of which said text is displayed in partial spectrum illumination, an auxiliary housing for a light source mounted to extend forwardly of said frame top at the approximate eye level of said seated viewer, and a natural daylight-simulating light source disposed in said auxiliary housing and limited to generating full spectrum illumination, whereby the rays of said full spectrum illumination impinge upon the eyes of said seated viewer to contributing to lessening eye strain as might be caused by said partial spectrum illumination.

* * * * *